US005327610A

United States Patent [19]

Smith

[11] Patent Number: 5,327,610

[45] Date of Patent: Jul. 12, 1994

[54] ADJUSTABLE, REMOVABLE, LOCKING HANDLE FOR FLOOR POLISHERS AND THE LIKE

[75] Inventor: David G. Smith, Nepean, Canada

[73] Assignee: Dustbane Products Limited/Les Produits Dustbane Limitee, Ottawa, Canada

[21] Appl. No.: 906,497

[22] Filed: Jun. 30, 1992

[30] Foreign Application Priority Data

Feb. 27, 1992 [CA] Canada ..... 2061996

[51] Int. Cl.[5] ..... A47L 11/162

[52] U.S. Cl. ..... 15/98; 15/49.1; 15/145; 15/144.1; 15/143.1; 403/370

[58] Field of Search ..... 15/49.1, 50.1, 98, 143.1, 15/144.1, 144.2, 144.3, 144.4, 145, 257.7; 51/174–177; 403/368, 370, 371, 344, 365, 366, 367, 369; 299/36, 39, 41

[56] References Cited

U.S. PATENT DOCUMENTS

| | | | |
|---|---|---|---|
| 1,710,416 | 4/1929 | Goeller | 403/370 |
| 2,221,315 | 11/1940 | Okun | 15/49.1 |
| 2,508,039 | 5/1950 | Neuwirth | 403/369 |
| 2,840,402 | 6/1958 | Hassel | 403/370 |
| 2,999,706 | 9/1961 | Wilcox | 403/370 |
| 3,433,514 | 3/1969 | Feighofen | 403/370 |
| 4,577,993 | 3/1986 | Allen et al. | 15/49.1 |
| 4,845,798 | 7/1989 | Genovese | 15/98 |

FOREIGN PATENT DOCUMENTS

| | | | |
|---|---|---|---|
| 1087356 | 10/1980 | Canada . | |
| 645344 | 6/1928 | France | 403/367 |
| 1068490 | 2/1954 | France | 15/145 |
| 252511 | 10/1948 | Switzerland | 15/145 |
| 264258 | 1/1950 | Switzerland | 15/145 |

*Primary Examiner*—Philip R. Coe
*Assistant Examiner*—Gary K. Graham
*Attorney, Agent, or Firm*—Dickinson, Wright, Moon, Van Dusen & Freeman

[57] ABSTRACT

A releasable clamp for the interior of an elongated tube, for use in telescopic tube arrangements and the like. The clamp comprises an outwardly expandable split ring having open ends and sides of cylindrical configuration, the sides of the split ring expanding outwardly to frictionally engage the interior surfaces of the tube when in expanded position, the split ring slidably movable longitudinally within the tube when the sides of the split ring are in unexpanded position. Wedges are provided, cooperating with the open ends of the split ring to bear against the ends of the split ring to force the sides of the split ring outwardly to expand it, tube engaging position. This releasable clamp may be used, for example, in an adjustable length handle for an appliance such as a floor polisher.

7 Claims, 1 Drawing Sheet

ADJUSTABLE, REMOVABLE, LOCKING HANDLE FOR FLOOR POLISHERS AND THE LIKE

BACKGROUND OF THE INVENTION

The present invention relates to a releasable clamp for the interior of a cylindrical tube. One particular application of such a clamp is in an adjustable length handle for an appliance such as a floor polisher.

Commercial floor polishers are conventionally heavy and bulky machines. A lower housing supports a motor and floor polisher brush or pad. A handle, which is adjustably pivotable at varying angles with respect to the housing and floor surface is secured to the rear of the housing. Transport wheels are mounted on the housing, towards the rear, to support the floor polisher and facilitate its movement during operation. U.S. Pat. No. 4,845,798 of Genovese issued Jul. 11, 1989 describes and illustrates a conventional floor polisher having a handle with a brace pivotally secured to the housing and to a collar which is slidably mounted about a portion of the handle. The lower end of the handle is pivotally secured to an upper part of the housing. In this manner limited pivotal movement of the handle with respect to the floor polisher housing is achieved.

Canadian Patent No. 1,087,356 of Fink et al issued Oct. 14, 1990 describes and illustrates an adjustable handle for a floor maintenance appliance such as a polisher in which the handle is longitudinally adjustable. The longitudinal adjustment of the handle is achieved through telescopic tubes within which are positioned a longitudinally movable rod on which is positioned a wedge construction or a cam-in-guide arrangement which, on movement of the rod, moves plungers in and out of locking apertures through overlapping portions of the telescopic tubes. Such prior art constructions of handles have not permitted ready disassociation of the handle from the housing of the floor polisher. This would be a desirable feature for example for transporting such floor polishers in condition where space is limited, or for storage.

It is an object of the present invention to provide an alternative construction of clamp mechanism for adjusting the length of appliance handles and other constructions of a telescopic tubular nature. It is a further object of the present invention to provide an appliance handle which is readily detachable from the rest of the appliance.

SUMMARY OF THE INVENTION

In accordance with the present invention there is provided a releasable clamp for the interior of a cylindrical tube. The clamp comprises an outwardly expandable split ring having open ends and sides of cylindrical configuration. The sides of the split ring expand outwardly to frictionally engage the interior surfaces of the tube when in expanded position. The split ring is slidably movable longitudinally within the tube when the sides of the split ring are in unexpanded position. The clamp further comprises wedges, slidable within the cylindrical tube and associated with the open ends of the split ring and relatively movable with respect thereto to bear against the ends of the split ring to force the sides of the split ring outwardly to expanded tube-engaging position. The clamp also comprises actuation means associated with at least one of the wedges so as to cause, as required, relative movement of the wedge with respect to the split ring to cause the split ring to move between expanded position and unexpanded position.

In a preferred embodiment of the present invention, the ends of the split ring are downwardly and inwardly bevelled and the wedges comprise respectively an upper and a lower bearing surface, one on either side of the split ring. The bearing surfaces have peripheries which are bevelled so as to mate with the bevelled ends of the split ring when in contact therewith.

The releasable clamp according to the present invention is well suited to telescopic tube applications, where it is desired adjusts the extent of longitudinal extension of one tube with respect to another and secure the tubes at a particularly selected position of longitudinal extension, and handles of appliances such as floor polishers, where the clamp permits adjusting the height of the handle or indeed removal of the handle from the rest of the floor polisher.

BRIEF DESCRIPTION OF THE DRAWINGS

These and other objects and advantages of the invention will become apparent upon reading the following detailed description and upon referring to the drawings in which.

Figures 1, 2, 3:
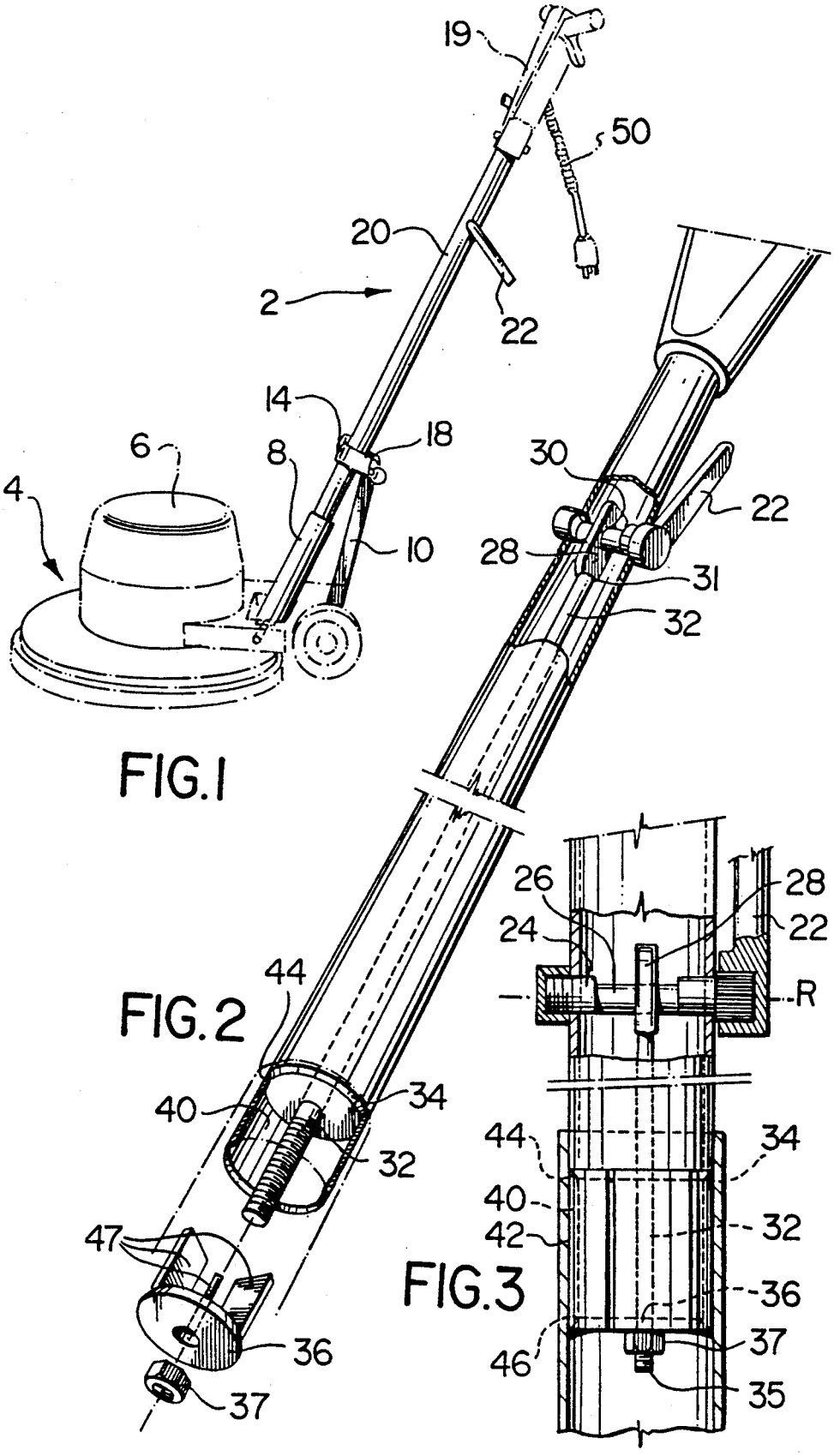
FIG. 1 is a perspective view of a handle construction, in accordance with the present invention, on a floor polisher.
FIG. 2 is a perspective, partial view in partial section of the handle of FIG. 2 illustrating in more detail the construction and operation of the components of that handle.
FIG. 3 is an enlarged elevation view, in partial section, of the clamp mechanism at the lower portion of the handle of FIGS. 1 and 2.

While the invention will be described in conjunction with an example embodiment, it will be understood that it is not intended to limit the invention to such embodiment. On the contrary, it is intended to cover all alternatives, modifications and equivalents as may be included within the spirit and scope of the invention as defined by the appended claims.

DETAILED DESCRIPTION OF THE INVENTION

In the drawings similar features have been given similar references numerals.

Turning to the drawings, in FIG. 1 there is illustrated an adjustable length handle system 2 for a floor polisher 4 in accordance with the present invention. Though shown in the association with a handle 4 for an appliance such as a floor polisher, and clearly inventive within that context, the handle system of the present invention may be readily adapted by one skilled in the art to other types of appliances and indeed other types of applications where a telescopic tube construction is required. The present invention is intended to embrace such applications as well as that of the illustrated embodiment.

Floor polisher 4 is provided with a housing 6 for the motor and polisher mechanism (brush, buffer pad, etc.) as shown in phantom in FIG. 1. Pivotally secured to the rear, upper surface of housing 6 as illustrated is an elongated tubular jacket 8. Spaced therefrom and similarly pivotable with respect to a portion of housing 6 is a brace 10, which brace is releasably securable, at its upper end, to a collar 14 by way of a releasable pin 18 through aligned apertures (not illustrated) through collar 14 and that upper end of brace 10.

From tubular jacket 8 extending upwardly to handle 19 is an elongated handle tube 20. The lower portion of handle tube 20 snugly fits within tubular jacket 8 and is slidable therewith, in telescopic tubular fashion.

As can be seen in more detail in FIG. 3, at the upper end of handle tube 20 is a lever handle 22 which is secured to axle 24 which passes through and is rotatably secured to the upper end of handle tube 20 as illustrated. Axle 24 rotates about axis R (FIG. 3). Cam surface 26 is provided centrally on axle 24, by (for example) machining that central portion of axle 24 to provide a cylindrical surface having a central axis which is offset from the axle's axis of rotation R. Thus, by rotating handle 22, axle 24 rotates about axis R causing cam surface 26 to rise or fall longitudinally, within handle tube 20.

Bar 28 is supported on cam surface 26 which passes through an aperture 30 in bar 28 as illustrated. To bar 28 is secured the upper end 31 of an elongated rod 32 which passes down through elongated tube 20 beyond its lower end, to terminate at bottom end 35.

Lower end 34 of handle tube 20 is provided with a downward and inward bevel as illustrated. To bottom 35 of rod is secured a plug 36 for example by means of a nut 37 fastened onto threads at lower end 35 of rod 32. The peripheral edges of plug 36 are upwardly and inwardly bevelled as can be seen in FIGS. 2 and 3. Between lower end 34 of tube 20 and plug 36 is seated a split ring 40 (FIG. 3) having cylindrical sides 42 and open upper ends 44 and lower end 46 the surfaces of which are bevelled to mate with confronting surfaces of, respectively, lower end 34 of handle tube 20 and side surfaces of plug 36. Plug 36 is longitudinally seated on lower end 35 of rod 32, so that it leaves little play between the upper and lower ends 44 and 46 respectively of split ring 40, and the corresponding lower surface 34 of tube 20 and sides of plug 36. Guide bars 47 (FIG. 2) extend upwardly from plug 36 within split ring 40 to assist in maintaining plug 36 in proper alignment with respect to ring 40. When not expanded, split ring 40 flushly but slidably fits within jacket tube 8, permitting the lower portion of handle tube 20 to slide freely longitudinally within jacket tube 8.

When lever handle 22 is rotated however, to lift cam surface 26 longitudinally within tube 20, and hence lift bar 28, rod 32 and plug 36 with respect to lower end 34 of tube 20, the force of the bevelled sides of plug 36 acting on the bevelled surface of lower end 46 of split ring 40 and the bevelled outer surface of lower end 34 of handle tube 20 acting on the bevelled surface of upper end 44 of split ring 40 causes that split ring to expand laterally, so that the sides 42 of split ring 40 are forced outwardly to frictionally engage corresponding inner surfaces of jacket tube 8, preventing further longitudinal movement of the lower portion of handle tube 20 within jacket tube 8. By rotating lever handle 22 in an opposite fashion, thereby lowering cam surface 26 longitudinally within tube 20, and hence bar 28, rod 32 and plug 36 with respect to handle tube 20, pressure is removed from the end of split ring 40, causing that ring to return to its unexpanded state and freeing handle tube 20 to move longitudinally with respect to jacket tube 8. In this manner, a means of adjusting the longitudinal length of the handle of floor polisher 4, over a limited range, but at infinitely variable positions within that range, is provided. Thus the height of handle tube 20 may be adjusted to suit the particular height of a worker (by providing suitable adjustment means for collar 14 and/or brace 10 with respect to handle tube 20 and floor polisher housing 6). As well, where an electrical cord 50 for the motor of floor polisher 4 runs down handle tube 20, by providing a plug and socket arrangement so that plug 50 can be broken at the lower end of handle tube 20, or where cord 50 is entirely disassociated from handle tube 20, by removing pin 18 to free brace 10 and rotating lever handle 22 so that split ring 40 is in its unexpanded state, handle tube 20 may be completely removed from jacket tube 8 for example for moving or storage of the floor polisher.

It will be readily appreciated that the split ring-movable wedge construction, positioned at the lower end of tube 20 as illustrated, may be adapted for many different uses, particularly where telescopic tubes are involved, with the means to cause the upper and lower wedges (bevelled surfaces 34 and 36) to move relatively closer together to expand outwardly the sides of split ring 40 being provided on a portion of the telescopic tube which fits within the other.

Thus it is apparent that there has been provided in accordance with the invention that fully satisfies the objects, aims and advantages set forth above. While the invention has been described in conjunction with a specific embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. A releasable clamp for engaging the interior of a cylindrical tube comprising:

(a) an outwardly expandable elongated split ring having open, bevelled ends and having cylindrical side portions for being spread to frictionally engage the interior surfaces of the tube, the split ring being slidably movable longitudinally within the tube when the sides of the split ring are not spread;

(b) wedge means for spreading said sides, said wedge means being slidable within the cylindrical tube and relatively movable with respect to the ends of the split ring to bear against the ends to force the side of the split ring to spread to a tube-engaging position, said wedge means comprising an elongated tube for being slidably received within said cylindrical tube and having an upper bearing surface at one end thereof located adjacent one end of said split ring and means forming a lower bearing surface located adjacent an opposite end of said split ring, said bearing surfaces being bevelled for mating with the bevelled ends of the split ring when in contact therewith; and (c) actuation means for providing relative movement of said wedge means with respect to the split ring to cause the sides of the split ring to spread and contract, said actuation means including a rod within said elongated tube and mounted for longitudinal movement with respect to said elongated tube, and lever means for producing longitudinal movement of the rod, said lever means being pivotally mounted in said elongated tube; wherein one end of said rod is mechanically coupled to said lever means such that actuation of the lever means, without relative rotation of the tubes, produces longitudinal movement of the rod with respect to said elongated tube, the lower bearing surface being secured to said rod and being relatively movable with respect to the split ring towards the upper bearing surface to cause the bearing surfaces to cooperate with the ends of the split ring to force the sides of the split ring outwardly into the spread, tube-engaging position.

2. A clamp according to claim 1 wherein the lever means comprises a lever handle secured to an axle pivotally mounted in and extending through the elongated tube, said axle having a cam surface positioned within said elongated tube, and a bar is mounted on said one end of the rod, the bar having an aperture through which passes said axle so that the bar within said aperture bears against said cam surface, actuation of the lever handle causing rotation of the axle so that the cam surface acts on the bar to cause said longitudinal movement of the rod.

3. A handle system comprising, in combination, an appliance, a tubular jacket secured to the appliance, and a releasable clamp in accordance with claim 1 for engaging said tubular jacket, wherein said elongated tube of said clamp forms a handle at the other end thereof for operating said appliance.

4. A handle system according to claim 3 wherein the appliance is a floor polisher.

5. A handle system according to claim 4 wherein the lever means comprises a lever handle secured to an axle pivotally mounted in and extending through the elongated tube, said axle having a cam surface positioned within said elongated tube, and a bar is mounted on said one end of the rod, the bar having an aperture through which passes said axle so that the bar within said aperture bears against said cam surface, actuation of the lever handle causing rotation of the axle so that the cam surface acts on the bar to cause said longitudinal movement of the rod.

6. A handle system according to claim 5 wherein said floor polisher has a housing having an upper surface, said cylindrical tube being secured to the upper surface so as to be pivotal at various angles with respect thereto, an elongated brace pivotally secured at one end to said upper surface at a location spaced from said cylindrical tube and releasably pivotably secured at the other end to said elongated tube for releasable detachment of said elongated tube, when the split ring is not spread and the brace has been released from attachment to said housing or said elongated tube, from said cylindrical tube and said floor polisher housing.

7. A handle system according to claim 6 wherein an aperture is provided in said other end of the brace alignable with an aperture in means secured to said upper bearing surface tube and a pin releasably fits into said aligned apertures whereby said brace is releasably secured to said elongated tube.

* * * * *